US007597653B1

(12) United States Patent
Lindemeier

(10) Patent No.: US 7,597,653 B1
(45) Date of Patent: Oct. 6, 2009

(54) EXERCISE APPARATUS WITH RESISTANCE SELECTION

(75) Inventor: John R. Lindemeier, Zimmerman, MN (US)

(73) Assignee: Brunswick Corporation, Lake Forest, IL (US)

( * ) Notice: Subject to any disclaimer, the term of this patent is extended or adjusted under 35 U.S.C. 154(b) by 196 days.

(21) Appl. No.: 11/834,753

(22) Filed: Aug. 7, 2007

(51) Int. Cl.
*A63B 21/04* (2006.01)

(52) U.S. Cl. ..... 482/129; 482/130

(58) Field of Classification Search ..... 482/92–94, 482/98–103, 121–130, 133–138; *A63B 21/02*
See application file for complete search history.

(56) References Cited

U.S. PATENT DOCUMENTS 4,010,948 A * 3/1977 Deluty ..... 482/120
4,600,189 A 7/1986 Olschansky et al.
4,600,196 A * 7/1986 Jones ..... 482/137
4,666,149 A 5/1987 Olschansky et al.
4,811,946 A * 3/1989 Pelczar ..... 482/5
5,039,092 A 8/1991 Olschansky et al.
5,067,708 A 11/1991 Oschansky et al.
5,074,551 A 12/1991 Olschansky et al.
5,348,524 A * 9/1994 Grant ..... 482/130
5,522,784 A * 6/1996 Grant ..... 482/130
5,876,313 A * 3/1999 Krull ..... 482/98
6,045,491 A * 4/2000 McNergney et al. ..... 482/121
7,037,246 B2 * 5/2006 Kim ..... 482/129
7,192,391 B2 * 3/2007 Kim ..... 482/129
2006/0189457 A1 * 8/2006 Ripley ..... 482/99
2008/0039302 A1 * 2/2008 Grant ..... 482/121
2008/0305936 A1 * 12/2008 Cao ..... 482/98
2008/0318740 A1 * 12/2008 Ross et al. ..... 482/92
2009/0023561 A1 * 1/2009 Ross et al. ..... 482/92

* cited by examiner

*Primary Examiner*—Loan H Thanh
*Assistant Examiner*—Oren Ginsberg

(57) ABSTRACT

Exercise apparatus has a rotary camming disc selectively configured to engage respective locking pins for engaging and disengaging selective numbers of force resistors for varying exercise resistance.

10 Claims, 9 Drawing Sheets

FIG. 5
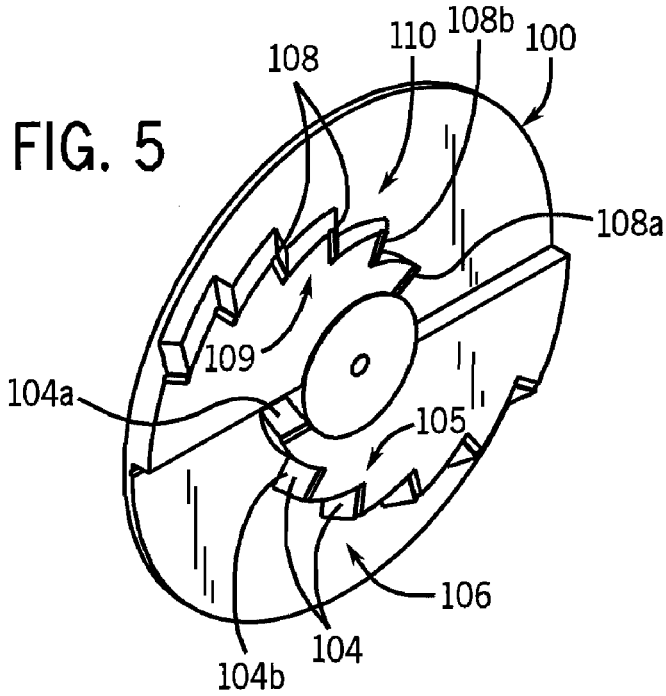
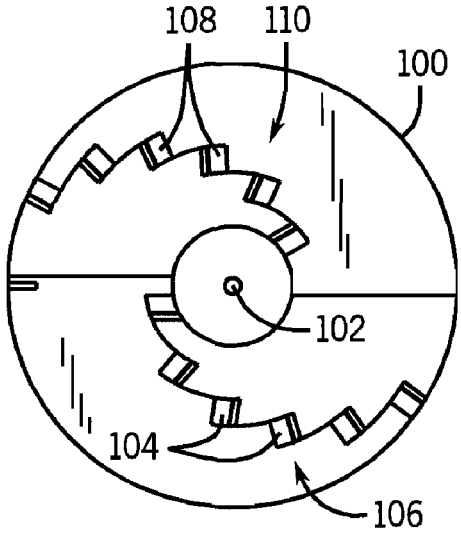
FIG. 6

FIG. 11
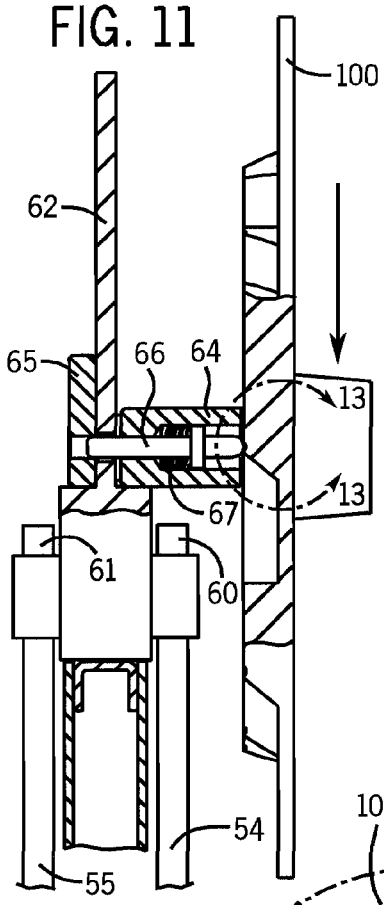
FIG. 12
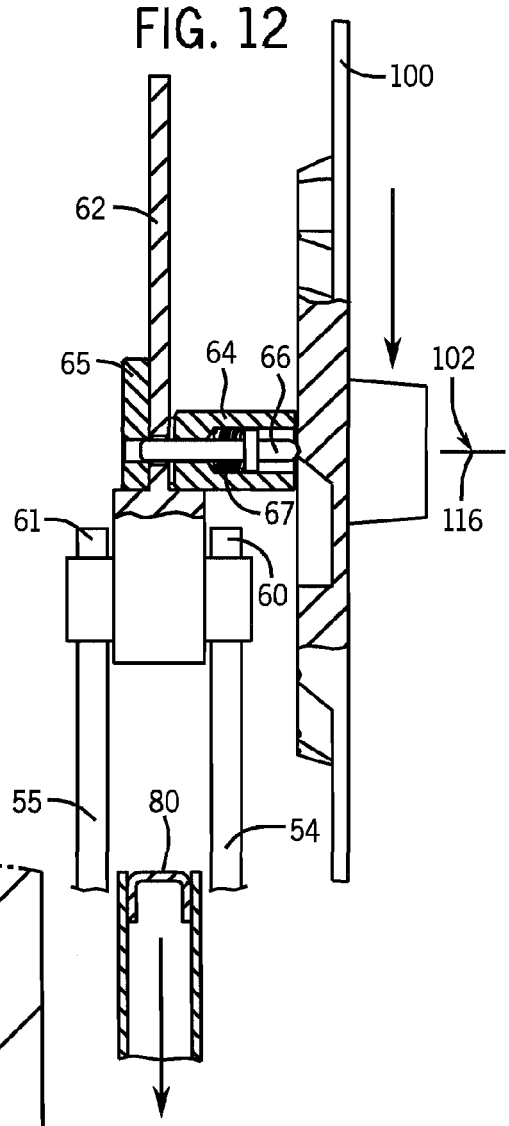
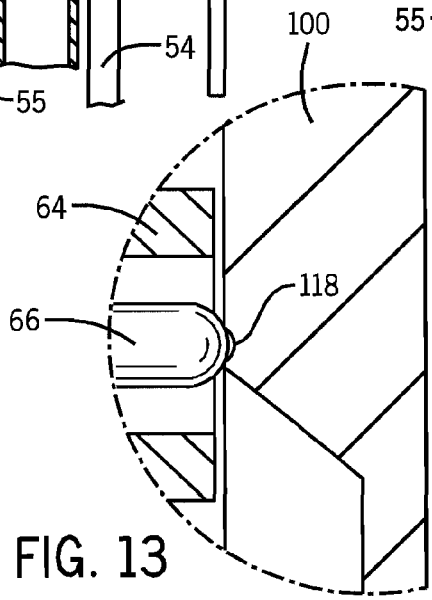
FIG. 13

EXERCISE APPARATUS WITH RESISTANCE SELECTION

BACKGROUND AND SUMMARY

The invention relates to exercise apparatus.

Exercise apparatus is known in the prior art having one or more force resistors, e.g. elastomeric bungees, coupled to a user engageable actuator to provide an opposing force resisting a given user exercise. A plurality of locking pins may selectively engage and disengage respective resistors to vary the resistance.

The present invention arose during continuing development efforts directed toward the noted exercise apparatus.

BRIEF DESCRIPTION OF THE DRAWINGS

FIG. 5 is a perspective view of a component of FIG. 4.

FIG. 6 is a plan view of the component of FIG. 5.

FIG. 11 is a sectional view taken along line 11-11 of FIG. 8.

FIG. 12 is like FIG. 11 and shows a further operational condition.

FIG. 13 is an enlarged view along line 13-13 of FIG. 11.

DETAILED DESCRIPTION

Prior Art

Figure 1:
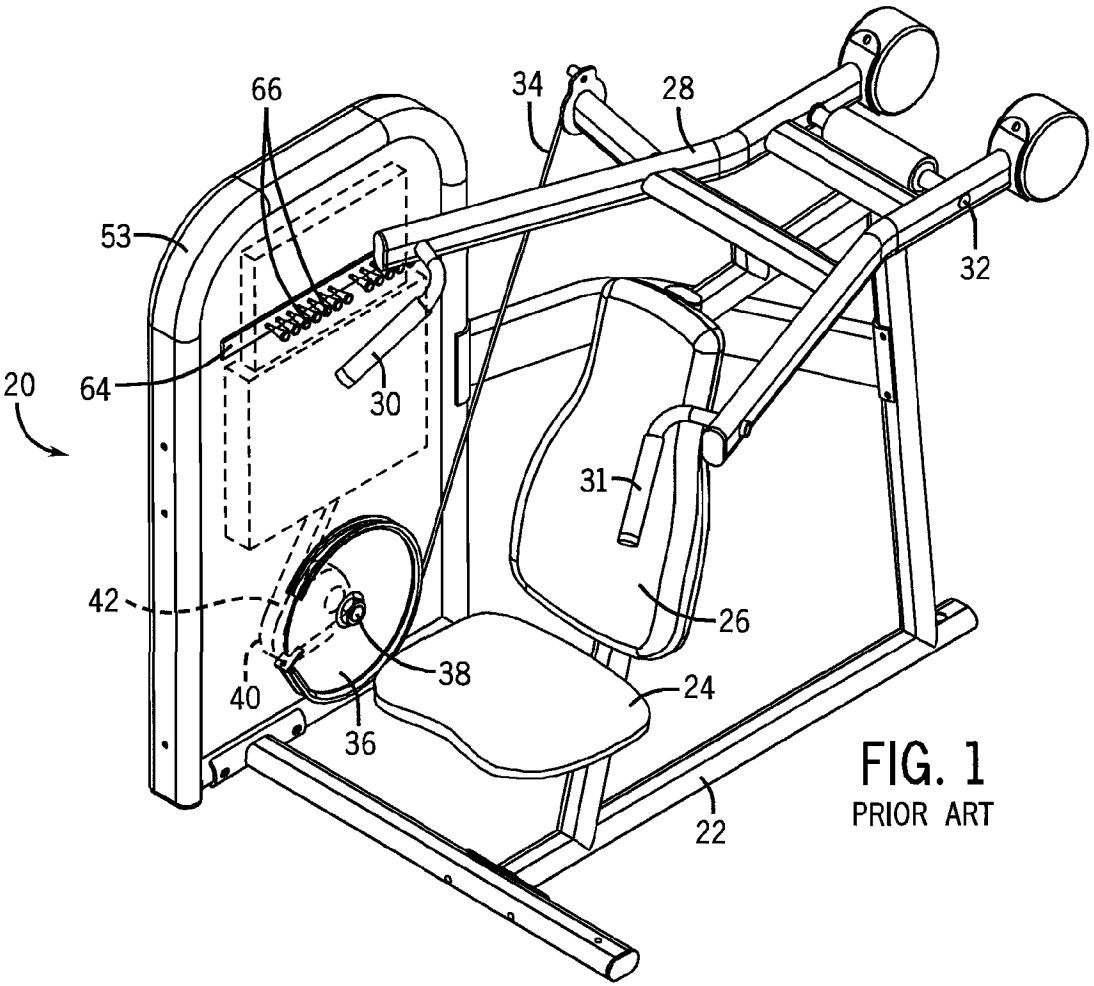
FIG. 1 PRIOR ART
FIG. 1 is a perspective view of exercise apparatus known in the prior art.
Figure 9:
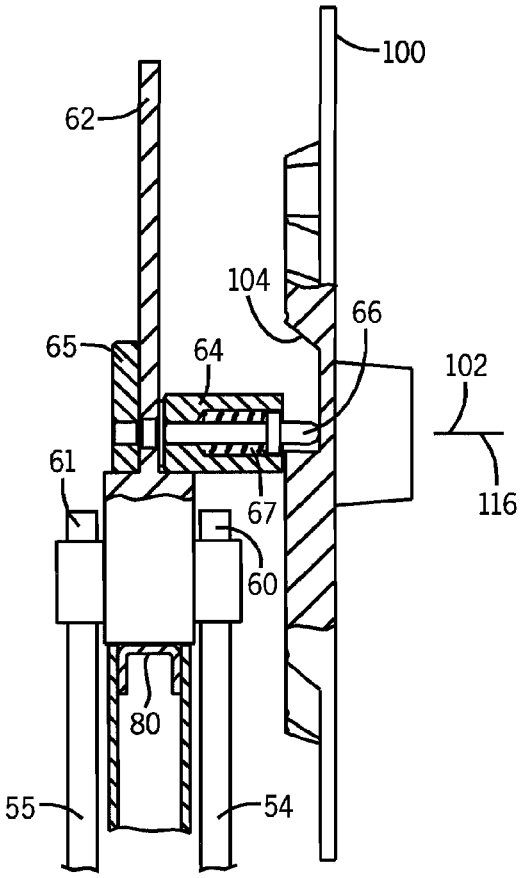
FIG. 9 is a sectional view taken along line 9-9 of FIG. 7.
Figure 10:
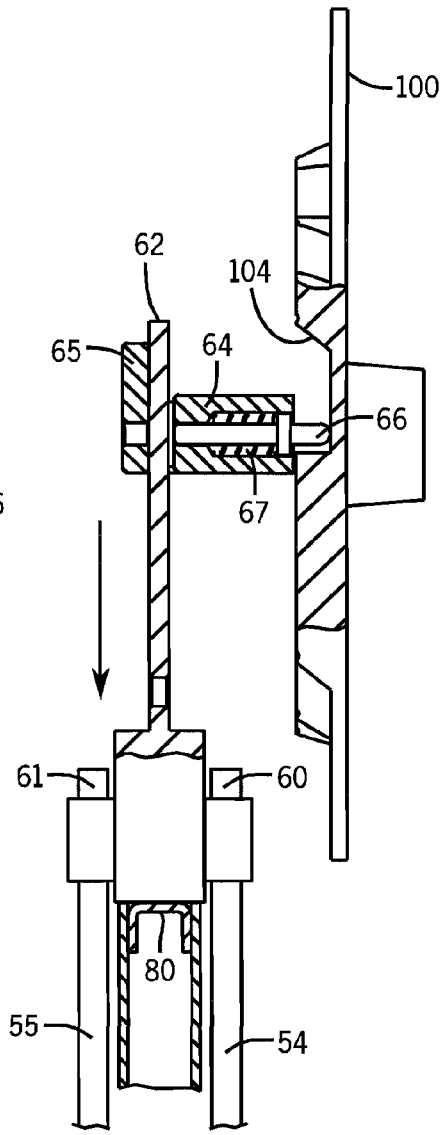
FIG. 10 is like FIG. 9 and shows a further operational condition.
Figure 14:
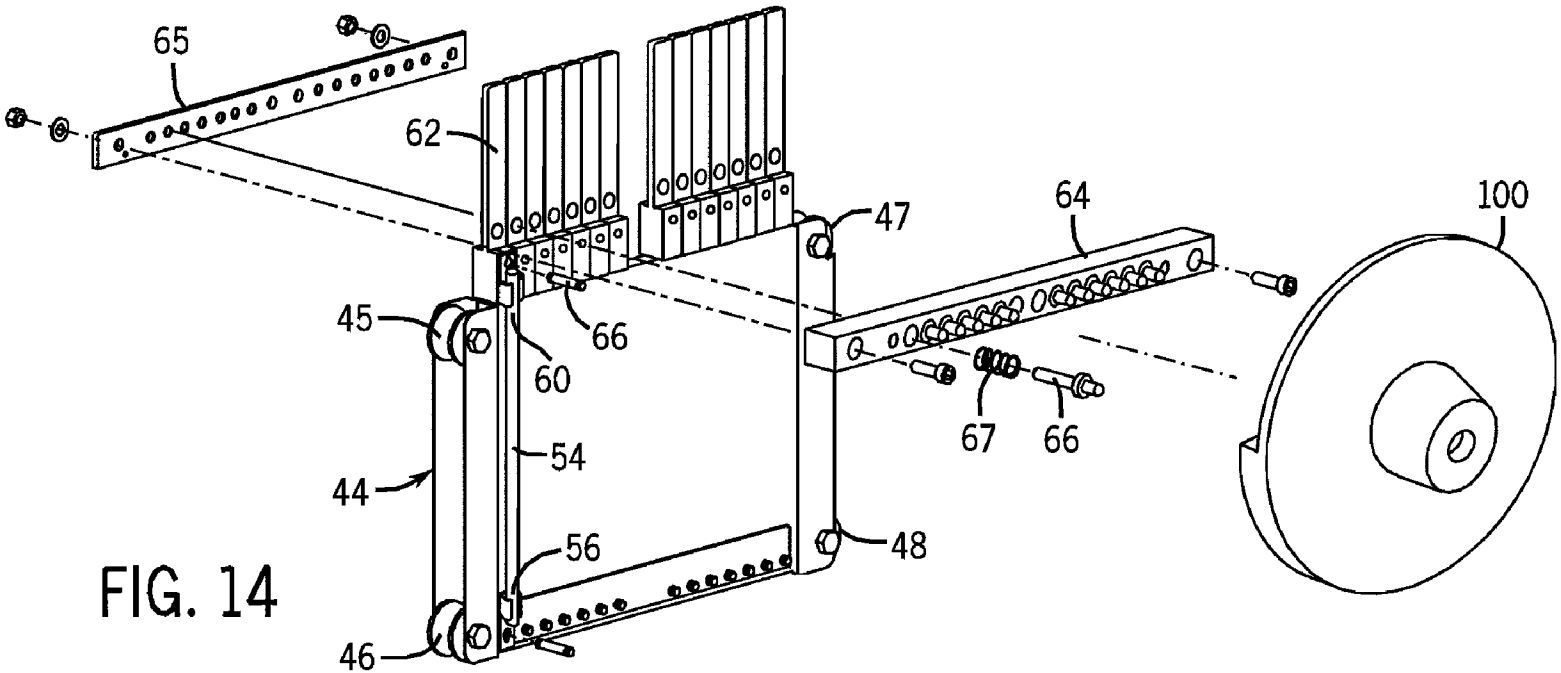
FIG. 14 is an exploded perspective view of a portion of FIG. 3.

FIG. 1 shows exercise apparatus 20 known in the prior art, and FIGS. 2-14 illustrate the present invention and use like reference numerals as FIG. 1 where appropriate to facilitate understanding. The exercise apparatus includes a frame 22 supporting a user seat 24 and user backrest 26, and an upper framework 28 having hand grips 30, 31 gripped by the user and pushed upwardly to rotate framework 28 about pivot 32 to pull cable 34 upwardly. Cable 34 is trained around pulley 36 on axle 38 which also has an eccentric cam 40 thereon, FIG. 3, which in turn has a belt or cable 42 trained therearound and connected at its upper end to a movable carriage 44 which is movable up and down by means of rollers 45, 46, 47, 48 rolling along tracks 50 and 52 supported by outer inverted U-shaped tower frame 53. Upward movement of cable 34 causes counterclockwise rotation of pulley 36 and cam 40 which in turn pulls carriage 44 downwardly via cable belt 42. The downward movement of carriage 44 is resisted by a plurality of force resistors 54, as provided by elastomeric bungees or other force resistor, each force resistor having a first lower end 56 coupled at lower carriage crossbar 58 to a user engageable actuator as provided by the connection through cable belt 42, eccentric cam 40, pulley 36, and cable 34, for providing an opposing force resisting a given user exercise, i.e. stretching of bungees 54 provides the noted exercise resistance. The bungee force resistors 54 have a second upper end at 60 each connected to a respective stake 62 which may be selectively pinned to front and rear stationary crossbars 64 and 65 of tower frame 53. A plurality of locking pins 66 are each moveable between first and second positions. The second position is a pushed-in position engaging and locking in place the upper end 60 at stake 62 of a respective bungee, FIG. 11, to enable the noted opposing force provided by the bungee upon movement of first end 56 downwardly, thus stretching the bungee and providing the noted exercise resistance. In some implementations, front and rear bungees 54 and 55, FIG. 11, are provided, each having a respective upper end 60, 61 connected to a common respective stake 62 which may be selectively pinned by a respective pin 66, all as is known. When the upper ends of respective bungees are pinned at stake 62, such upper ends of the bungees remain in place during downward movement of the carriage, FIG. 12, thus stretching the pinned bungees. Unpinned bungees, FIGS. 9, 10, do not remain in place, and stake 62 resting on carriage crossbar 80 moves downwardly therewith during downward movement of carriage 44, without stretching the respective bungees, which bungees thus do not provide exercise resistance. In the prior art, the user pushes in or pulls out selected pins 66 to vary exercise resistance, namely by engaging or disengaging selective bungees at respective stakes 62 to thus provide a selected amount of exercise resistance. The noted second position of the locking pin, FIGS. 11, 12, engages and locks in place the second upper end of the respective bungee to enable the noted opposing force provided by such bungee upon movement of the lower end 56 of the bungee to stretch the bungee. The noted first position of the locking pin, FIGS. 9, 10, releases the upper end of the bungee at stake 62 to disable the noted opposing force. The plurality of locking pins 66 are selectively movable between the noted first and second positions such that selective ones of the locking pins may be in the noted first released position, FIGS. 9, 10, and selective others of the locking pins may be in the noted second locking position, FIGS. 11, 12. The greater the number of locking pins in the second locking position, FIGS. 11, 12, the greater the noted opposing force.

The structure and operation described thus far is known in the prior art. It has been found that the current method of selecting increasing resistance by pressing in each incremental pin in a specific sequence is not intuitive and not user friendly, and that the user may possibly index the pins incorrectly to achieve a total final resistance which is not what is desired. It has also been found that the indexing may create a high offset load in carriage 44.

PRESENT INVENTION

Figure 2:
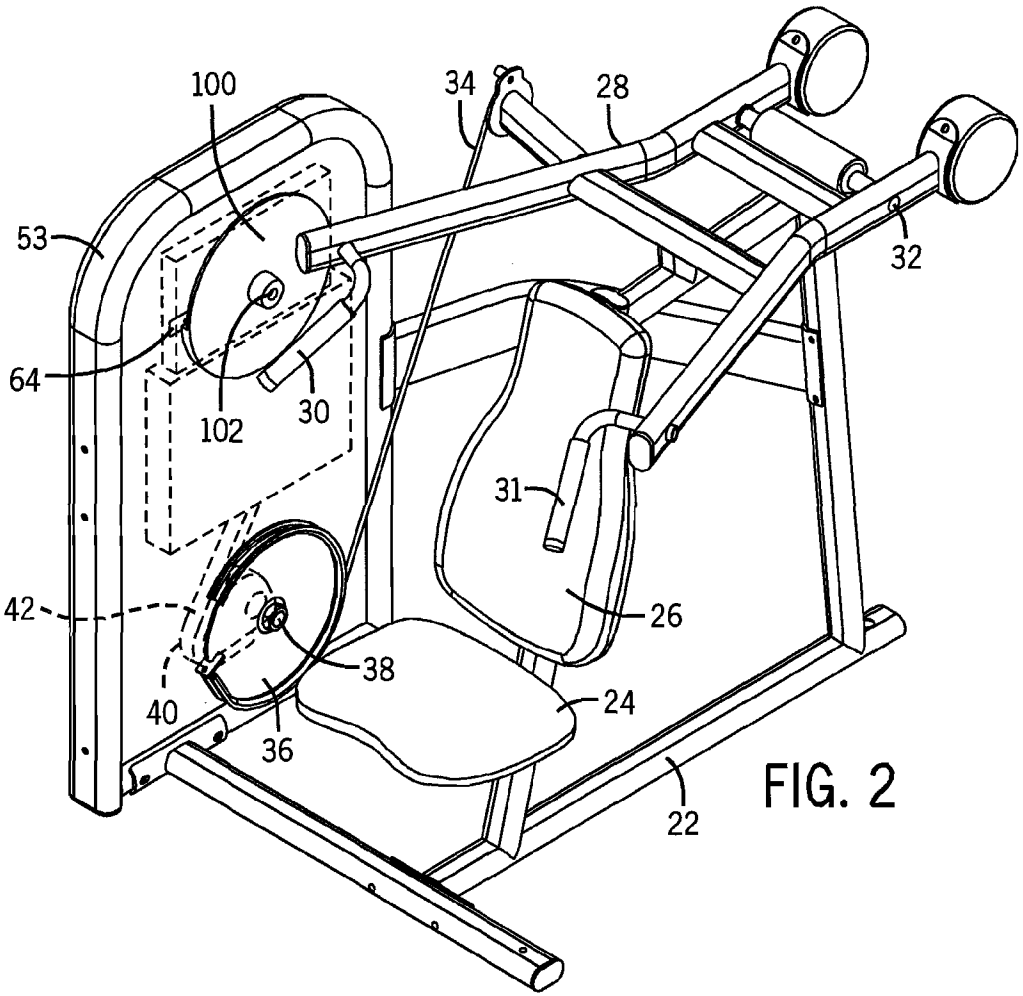
FIG. 2 is like FIG. 1 and shows the present invention.
Figure 3:
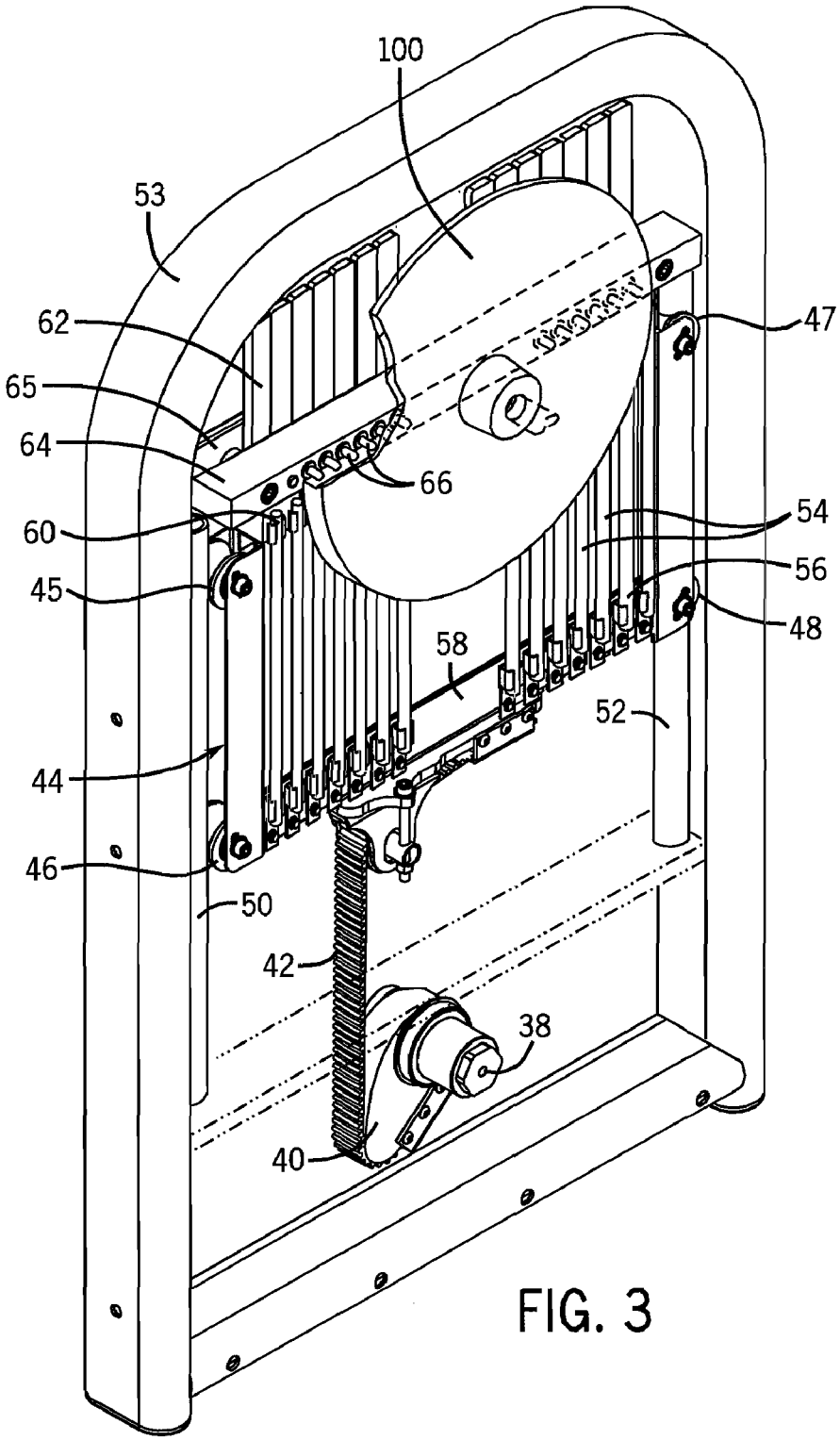
FIG. 3 is an enlarged view of a portion of FIG. 1 partially cut away.
Figure 4:
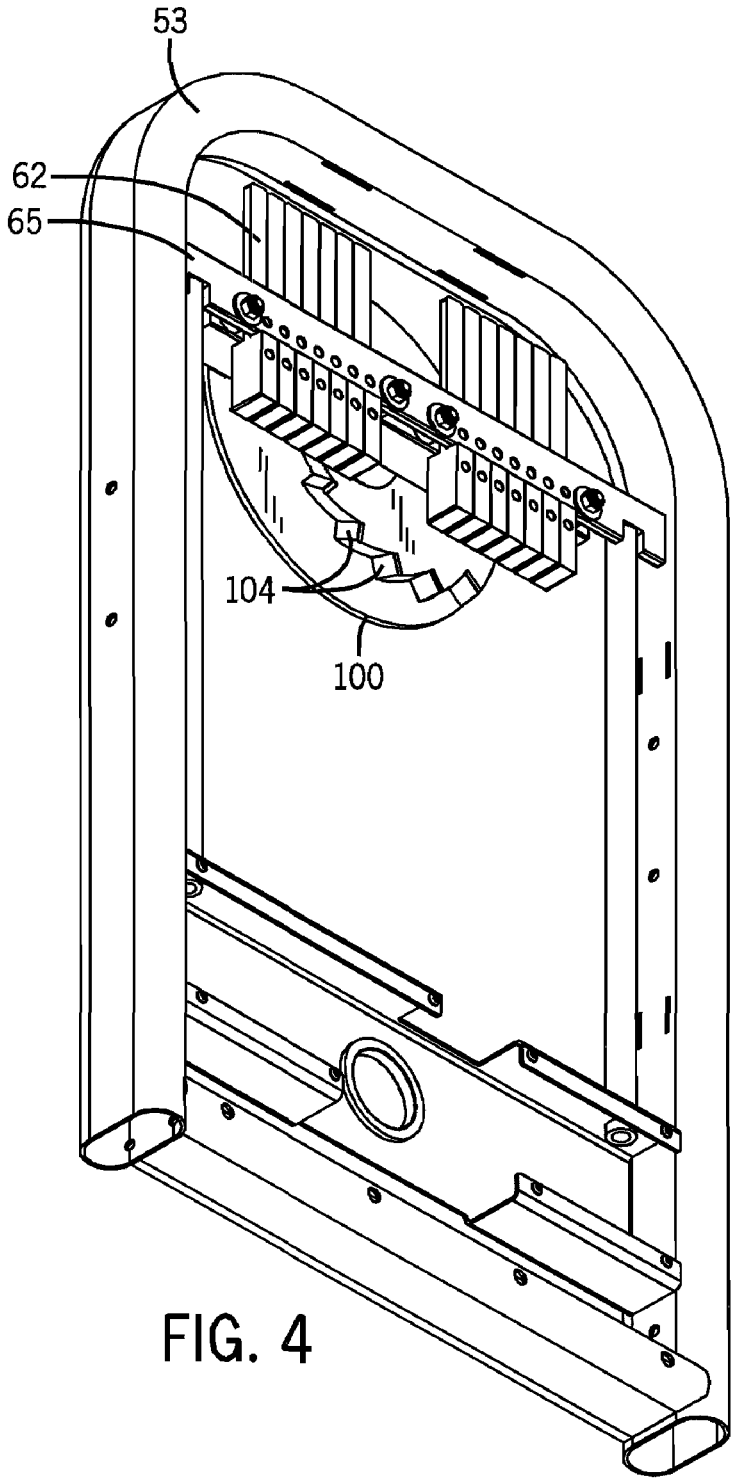
FIG. 4 is a perspective view from a different angle of a portion of FIG. 3.
Figure 7:
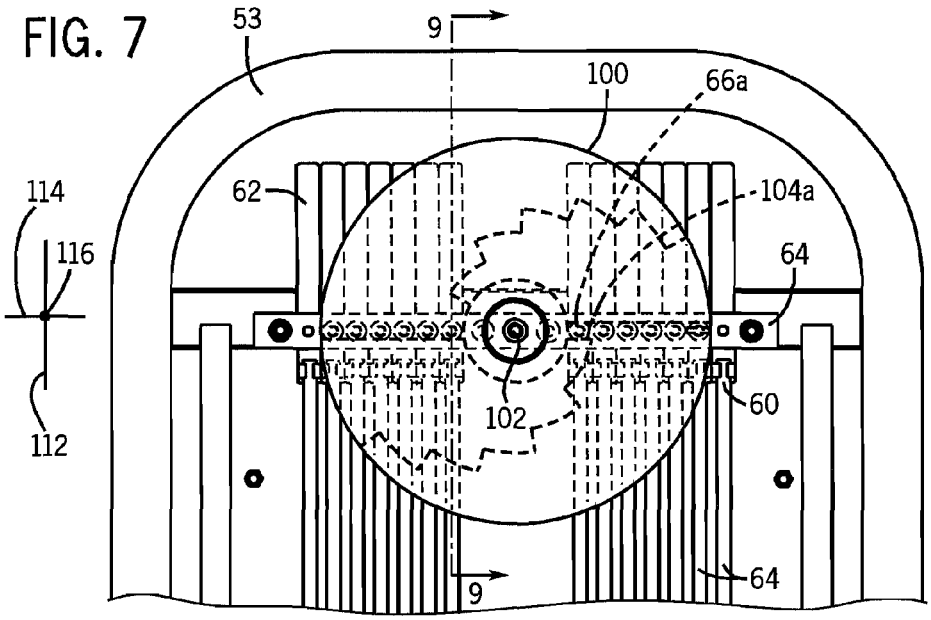
FIG. 7 is a plan view of a portion of FIG. 3.
Figure 8:
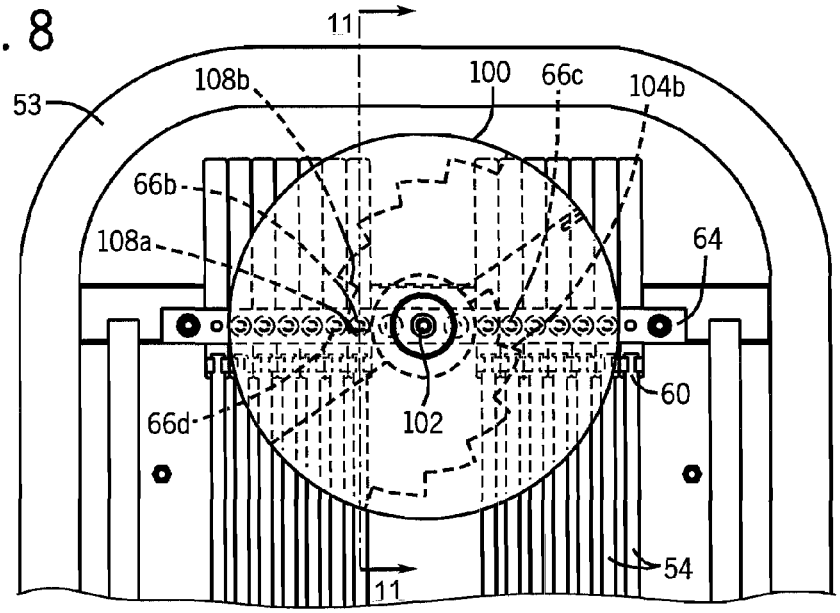
FIG. 8 is like FIG. 7 and illustrates operation.

In the present system, a cam is provided in the form of a rotational disc 100, FIG. 2+, which is user-engageable and movable in a first direction, e.g. counterclockwise about pivot axis 102 to increase the noted opposing force providing exercise resistance, and movable in a second direction, e.g. clockwise about pivot axis 102, to decrease the noted opposing force. The camming disc has a plurality of camming surfaces 104, FIGS. 5, 9, respectively engaging and camming increasing numbers of locking pins 66 from the noted first position of FIGS. 9, 10 to the noted second position of FIGS. 11, 12 in response to movement of the cam in the noted first direction, e.g. rotation of disc 100 counterclockwise in FIGS. 2, 3, whereby to increase the noted opposing force thus increasing exercise resistance. Cam surfaces 104 respectively disengage and release increasing numbers of locking pins 66 from the noted second position of FIGS. 11, 12 to the noted first position of FIGS. 9, 10 in response to movement of the cam in the noted second direction, e.g. clockwise rotation of disc 100 in FIGS. 2, 3, whereby to decrease the noted opposing force thus decreasing exercise resistance. Disc 100 is rotationally mounted to stationary crossbar 64 to pivot about axis 102.

Disc 100 has a plurality of cam steps 104 along a step pattern 106, FIG. 5, extending radially and arcuately in a spiral from the center of the disc. The disc has first and second sets 105 and 109 of cam steps 104 and 108 extending along respective first and second step patterns 106 and 110, each step pattern extending radially and arcuately in a spiral from the center of the disc. First and second step patterns 106 and 110 are on diametrically opposite sides of the disc. Cam steps 104 of first set 105 are staggered relative to cam steps 108 of second set 109 such that upon rotation of disc 100, a first cam step 104*a* of first set 105 engages a first locking pin 66*a*, FIG. 7, and upon continued counterclockwise rotation of disc 100, FIG. 8, a first cam step 108*a* of second set 109 engages a second locking pin 66*b*, and upon continued counterclockwise rotation of disc 100, a second cam step 104*b* of first set 105 engages a third locking pin 66*c*, and upon continued counterclockwise rotation of disc 100, a second cam step 108*b* of second set 109 engages a fourth locking pin 66*d*, and so on. The force resistors are provided by the noted plurality of parallel elastomeric bungees 54, or other force resistors, as in the prior art, extending longitudinally along a longitudinal direction 112 between the noted first and second ends 56 and 60, the bungees being laterally spaced side by side along a lateral direction 114. Longitudinal and lateral directions 112 and 114 define a plane, which is the plane of the page in FIGS. 7, 8. Disc 100 lies in such plane and is rotational about axis 102 extending along a transverse direction 116 which is into the page in FIGS. 7, 8. Transverse direction 116 is transverse to each of longitudinal and lateral directions 112 and 114. Locking pins 66 translate in and out along transverse direction 116 between the noted first and second positions. Cam steps 104, 108 of the disc are provided by tapered ramps as shown at 104 in FIG. 9, which ramps extend obliquely relative to transverse direction 116. The disc may be provided with small notches such as 118, FIG. 13, engaging a respective pin 66 for providing tactile feedback to the user. It is preferred that the noted camming step ramps be positioned so that one of the pins 66 is indexed approximately every 15° of rotation of disc 100, and that at approximately 165° all pins are indexed, i.e. pushed into their noted second locking position, FIGS. 11, 12. In the next 15° increment, all pins 66 are un-indexed, i.e. released to their noted first unlocking position, FIGS. 9, 10. Disc 100 can be rotated in either direction to increase or decrease exercise resistance, except that at the start, FIG. 7, disc 100 can only be rotated in one direction, i.e. counterclockwise, to index the first pin 66*a*. Locking pins 66 are preferably biased by respective springs 67 to the noted first unlocking position.

In further embodiments, the noted cam steps or ramps may be oriented so that the locking pins can be selectively engaged and actuated in any selected order. For example, the cam steps of the noted first and second sets may be oriented such that upon rotating the disc a first cam step of the first set engages a first locking pin, and upon continued rotation of the disc a second cam step of the first set engages a second locking pin, and upon continued rotation of the disc a first cam step of the second set engages a third locking pin, and upon continued rotation of the disc a second cam step of the second set engages a fourth locking pin, and so on.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. Exercise apparatus comprising a plurality of resilient force resistors each having a first end coupled to a user engageable actuator for providing an opposing force resisting a given user exercise, said force resistors each having a second end, a plurality of locking pins each movable between first and second positions, said second position engaging and locking in place said second end of a respective said force resistor to enable said opposing force provided by said force resistor upon movement of said first end, said first position releasing said second end of said force resistor to disable said opposing force, said plurality of locking pins being selectively movable between said first and second positions such that selective ones of said locking pins may be in said first position, and selective others of said locking pins may be in said second position, the greater the number of locking pins in said second position the greater said opposing force, a user-engageable cam movable in a first direction to increase said opposing force, and movable in a second direction to decrease said opposing force, said cam having a plurality of cam surfaces respectively engaging and camming increasing numbers of said locking pins from said first position to said second position in response to movement of said cam in said first direction, whereby to increase said opposing force, said cam surfaces respectively disengaging and releasing increasing numbers of said locking pins from said second position to said first position in response to movement of said cam in said second direction, whereby to decrease said opposing force, wherein said cam is a rotational disc.

2. The exercise apparatus according to claim 1 wherein said disc has a plurality of cam steps along a step pattern extending radially and arcuately in a spiral from the center of said disc.

3. The exercise apparatus according to claim 2 comprising first and second sets of said cam steps extending along respective first and second said step patterns, each step pattern extending radially and arcuately in a spiral from the center of said disc, said first and second step patterns being on diametrically opposite sides of said disc.

4. The exercise apparatus according to claim 3 wherein said cam steps of said first set are staggered relative to said cam steps of said second set such that upon rotation of said disc a first cam step of said first set engages a first locking pin, and upon continued rotation of said disc a first cam step of said second set engages a second locking pin, and upon continued rotation of said disc a second cam step of said first set engages a third locking pin, and upon continued rotation of said disc a second cam step of said second set engages a fourth locking pin, and so on.

5. The exercise apparatus according to claim 1 wherein said force resistors comprise a plurality of parallel elastomeric bungees extending longitudinally along a longitudinal direction between said first and second ends, said bungees being laterally spaced side by side along a lateral direction, said longitudinal and lateral directions defining a plane, said disc lying in said plane and rotational about an axis extending along a transverse direction transverse to each of said longitudinal and lateral directions.

6. The exercise apparatus according to claim 5 wherein said locking pins translate along said transverse direction between said first and second positions, and said disc has a plurality of cam steps comprising tapered ramps extending obliquely relative to said transverse direction.

7. A method for changing resistance in an exercise apparatus having a plurality of resilient force resistors each having a first end coupled to a user engageable actuator for providing an opposing force resisting a given user exercise, said force resistors each having a second end, a plurality of locking pins each movable between first and second positions, said second position engaging and locking in place said second end of a respective said force resistor to enable said opposing force provided by said force resistor upon movement of said first end, said first position releasing said second end of said force resistor to disable said opposing force, said plurality of locking pins being selectively movable between said first and second positions such that selective ones of said locking pins may be in said first position, and selective others of said locking pins may be in said second position, the greater the number of locking pins in said second position the greater said opposing force, a user-engageable cam movable in a first direction to increase said opposing force, and in a second direction to decrease said opposing force, said cam is a rotational disc, said cam having a plurality of cam surfaces respectively engaging and camming increasing numbers of said locking pins from said first position to said second position in response to movement of said cam in said first direction, whereby to increase said opposing force, said cam surfaces respectively disengaging and releasing increasing numbers of said locking pins from said second position to said first position in response to movement of said cam in said second direction, whereby to decrease said opposing force, said method comprising moving said cam in said first direction to increase exercise resistance, and moving said cam in said second direction to decrease exercise resistance.

8. The method according to claim 7 comprising rotating said disc in a first rotational direction to increase exercise resistance, and rotating said disc in a second opposite rotational direction to decrease exercise resistance.

9. The method according to claim 8 comprising providing said disc with a plurality of cam steps along a step pattern extending radially and arcuately in a spiral from the center of said disc, providing first and second sets of said cam steps extending along respective first and second said step patterns on diametrically opposite sides of said disc, staggering said cam steps of said first set relative to said second set, and comprising rotating said disc such that a first cam step of first set engages a first locking pin, and continuing to rotate said disc such that a first cam step of said second set engages a second locking pin, and continuing to rotate said disc such that a second cam step of said first set engages a third locking pin, and continuing to rotate said disc such that a second cam step of said second set engages a fourth locking pin, and so on.

10. The method according to claim 8 comprising providing said disc with a plurality of cam steps along a step pattern extending radially and arcuately in a spiral from the center of said disc, providing first and second sets of said cam steps extending along respective first and second said step patterns on diametrically opposite sides of said disc, staggering said cam steps of said first set relative to said second set, and comprising rotating said disc such that a first cam step of said first set engages a first locking pin, and continuing to rotate said disc such that a second cam step of said first set engages a second locking pin, and continuing to rotate said disc such that a first cam step of said second set engages a third locking pin, and continuing to rotate said disc such that a second cam step of said second set engages a fourth locking pin, and so on.

* * * * *